US008286430B2

(12) United States Patent
Swintek et al.

(10) Patent No.: US 8,286,430 B2
(45) Date of Patent: Oct. 16, 2012

(54) STEAM TURBINE TWO FLOW LOW PRESSURE CONFIGURATION

(75) Inventors: Roy P. Swintek, Altamont, NY (US); Dale W. Ladoon, Niskayuna, NY (US); James E. Olson, Mechanicville, NY (US)

(73) Assignee: General Electric Company, Schenectady, NY (US)

( * ) Notice: Subject to any disclaimer, the term of this patent is extended or adjusted under 35 U.S.C. 154(b) by 804 days.

(21) Appl. No.: 12/473,740

(22) Filed: May 28, 2009

(65) Prior Publication Data

US 2010/0300101 A1 Dec. 2, 2010

(51) Int. Cl.
*F01B 31/16* (2006.01)

(52) U.S. Cl. ..... 60/694; 60/697

(58) Field of Classification Search ..... 60/685, 60/694–697
See application file for complete search history.

(56) References Cited

U.S. PATENT DOCUMENTS

| | | | | |
|---|---|---|---|---|
| 1,375,076 | A * | 4/1921 | Baumann | 60/690 |
| 3,552,877 | A | 1/1971 | Christ et al. | |
| 4,013,378 | A | 3/1977 | Herzog | |
| 4,306,418 | A | 12/1981 | Nishioka | |
| 4,353,217 | A | 10/1982 | Nishioka et al. | |
| 4,557,113 | A | 12/1985 | Silvestri, Jr. et al. | |
| 4,567,729 | A | 2/1986 | Roddis | |
| 5,174,120 | A | 12/1992 | Silvestri, Jr. | |
| 6,360,543 | B2 * | 3/2002 | Koronya et al. | 60/690 |
| 6,484,503 | B1 * | 11/2002 | Raz | 60/685 |
| 6,814,345 | B2 | 11/2004 | Inoue | |
| 6,896,475 | B2 | 5/2005 | Graziosi et al. | |
| 7,111,832 | B2 | 9/2006 | Inoue | |

* cited by examiner

*Primary Examiner* — Hoang Nguyen
(74) *Attorney, Agent, or Firm* — Ernest G. Cusick; Frank A. Landgraff

(57) ABSTRACT

An exhaust system for a double flow steam turbine providing a separate external exhaust path from an upper section of a turbine outlet of a first turbine section to a first condenser and a separate external exhaust path from a lower section the turbine outlet of the first turbine section to the first condenser. A separate external exhaust path from an upper section of a turbine outlet of a second turbine section and a separate external exhaust path from a lower section of the turbine outlet of the second turbine section is also provided.

18 Claims, 6 Drawing Sheets

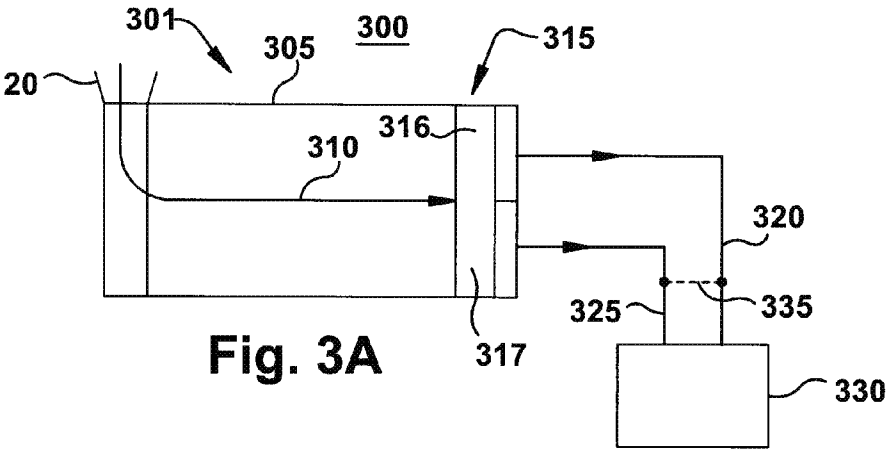
Fig. 3A
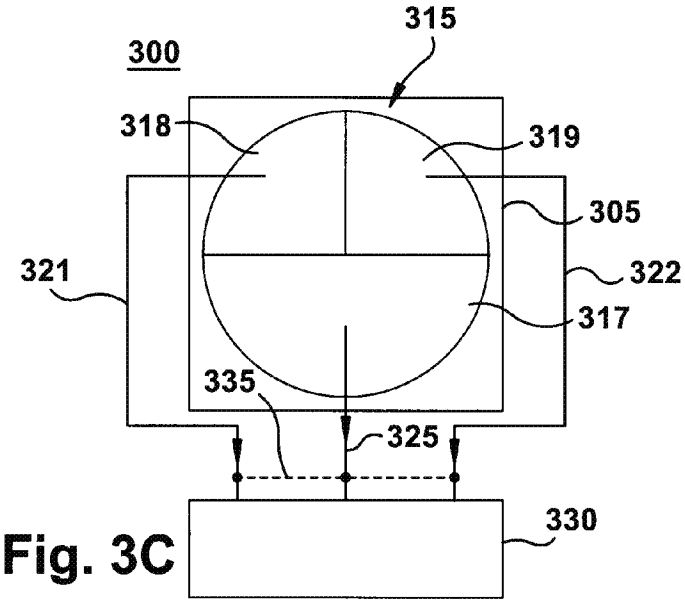
Fig. 3B
Fig. 3C

STEAM TURBINE TWO FLOW LOW PRESSURE CONFIGURATION

BACKGROUND OF THE INVENTION

The invention relates generally to steam turbines and more specifically to steam turbine exhaust arrangements.

In the discharge of exhaust steam from an axial flow turbine, for example discharge of this exhaust steam to a condenser, it is desirable to provide as smooth a flow of steam as possible and to minimize energy losses from accumulation of vortices and turbulences and non-uniformity in such flow. Usually the exhaust from the turbine is directed into an exhaust hood and from there to through a discharge opening in the hood in a direction essentially normal to the axis of the turbine into a condenser. It is desirable to achieve a smooth transition from axial flow at the exhaust of the turbine to radial flow in the exhaust hood and thence a smooth flow at the discharge opening of this hood into the condenser.

In the constructing of an effective exhaust hood for use with such an axial flow turbine it is desirable to avoid acceleration losses within any guide means employed therein and to achieve a relatively uniform flow distribution at the discharge opening of the exhaust hood for the most efficient conversion of energy in the turbine and effective supplying of exhaust steam to the condenser to which it is connected.

It is also desirable to achieve optimum efficiency at the last stage buckets of the turbine prior to exhaust from the turbine by achieving a relatively uniform circumferential and radial pressure distribution in the exit plane of the last stage buckets. Usually, attempts have been made to accomplish these results while employing a hood having as short an axial length as possible, so as to limit the axial size of the turbine train.

The prior art has employed, in the exhaust duct connected to the turbine, vanes, which have smoothly curved surfaces for effectively changing the axial flow of the steam from the turbine to the generally radial flow. For example of such an arrangement for converting the axial flow of the exhaust from the turbine to radial flow is shown in U.S. Pat. No. 3,552,877 by Christ et al. Further developments in prior art exhaust hoods for axial flow turbines, such as U.S. Pat. No. 4,013,378 by Herzog, have incorporated multiple sets of vanes for further smoothing flow. The exhaust hood includes a first set of guide vanes arranged in an exhaust duct connected to the turbine adjacent the last stage buckets thereof. These vanes are curved to provide a relatively smooth transition of steam flow from an axial direction to a generally radial direction. A guide ring circumferentially surrounds the first set of guide vanes and a plurality of secondary vanes are circumferentially spaced around this guide ring. Steam, which is discharged radially from the first set of vanes to the secondary vanes, is directed by the secondary vanes to the discharge opening of the exhaust hood. The secondary vanes are substantially equally spaced around the guide ring and are curved at different angles to effect different angles of discharge of steam from these vanes. The angles of discharge are chosen so as to direct the steam toward the discharge opening of the exhaust hood in a manner achieving substantially uniform flow distribution across the exit plane of the last stage buckets and across the plane of the discharge opening. However, while such vanes may be optimized for one set of flow conditions, they may operate with significantly less effectiveness at other flows.

Diffusers, for example, are commonly employed in steam turbines. Effective diffusers can improve turbine efficiency and output. Unfortunately, the complicated flow patterns existing in such turbines as well as the design problems caused by space limitations make fully effective diffusers almost impossible to design. A frequent result is flow separation that fully or partially destroys the ability of the diffuser to raise the static pressure as the steam velocity is reduced by increasing the flow area. For downward exhaust hoods used with axial steam turbines the loss from the diffuser discharge to the exhaust hood discharge varies from top to bottom. At the top, much of the flow must be turned 180 degrees to place it over the diffuser and inner casing, then turned downward. Pressure at the top is thus higher than at the sides, which are in turn higher than at the bottom.

Adding further complication to the function of exhaust hoods is a problem of exhausting to separate condensers from opposing turbine sections in a dual flow steam turbine, such as a dual flow, low-pressure steam turbine. Multiple pressure condensers are commonly used and improve the heat rate for two basic reasons. They provide a lower average back pressure and the condensate leaving the condenser has a higher temperature than single pressure condensers. Back pressure of multi-pressure units is lower because the heat rejection per unit length of condenser is more uniform. Thermodynamically this means that heat is transferred at a lower average temperature difference, that is, more efficiently. A double flow steam turbine with multiple flow paths to condensers is known (Nishioka, U.S. Pat. No. 4,306,418).

Opposing sections of dual axial flow steam turbines traditionally exhaust into a common exhaust hood that surrounds the opposing sections and then exhaust into a common condenser. In order to exhaust to separate condensers of separate sections of a multi-section condenser, it is known to utilize baffles that divides the exhaust hood for each of a first turbine section and a second turbine section. The baffling may further divide the condenser into separate sections, each separate section of the condenser in fluid communication with one of the divided sections of the exhaust hood. Thus the opposing turbine sections may be exhausted into separate condenser sections, with different operating pressures. (See Silvestri et al., U.S. Pat. No. 4,557,113).

It is further known (Silvestri, U.S. Pat. No. 5,174,120) to provide a vertical divider plate in the exhaust flow from an outlet in each of opposing sections of a double flow steam turbine and directing the divided flow to separate condensers. More specifically, the vertical divider plate separates the flow from the annulus of the turbine outlet (at a respective end of the turbine section) flowing between an inner flow guide and outer flow guide. A further vertical divider plate(s) separates the exhaust hood vertically along an axial direction. The vertically divided exhaust hood may then be placed in communication with condensers of separate pressure, allowing a lateral separation of the exhaust from the turbine section. The laterally separated exhaust may then be directed to specific condensers.

FIG. 1 illustrates a perspective partial cutaway of a double flow steam turbine a portion of a steam turbine. FIG. 2 illustrates a portion of the double flow steam turbine including an exhaust flow path. The steam turbine, generally designated 10, includes a rotor 12 mounting a plurality of turbine buckets 14. An inner casing 16 is also illustrated mounting a plurality of diaphragms 18. A centrally disposed generally radial steam inlet 20 applies steam to each of the turbine buckets and stator blades on opposite axial sides of the turbine to drive the rotor. The stator vanes of the diaphragms 18 and the axially adjacent buckets 14 form the various stages of the turbine forming a flow path and it will be appreciated that the steam is exhausted from the final stage of the turbine for flow into a condenser not shown.

Also illustrated is an outer exhaust hood 22, which surrounds and supports the inner casing of the turbine as well as other parts such as the bearings. The turbine includes steam guides 24 for guiding the steam exhausting from the turbine into an outlet 26 for flow to one or more condensers. With the use of an exhaust hood supporting the turbine, bearings and ancillary parts, the exhaust steam path is tortuous and subject to pressure losses with consequent reduction in performance and efficiency. A plurality of support structures may be provided within the exhaust hood 22 to brace the exhaust hood and to assist in guiding the steam exhaust flow. An exemplary support structure 30 is situated to receive and direct the steam exhaust flow 35 from the steam turbine 10. The diffusion of the steam is restricted to the volume in the exhaust hood 22.

The traditional exhaust hood arrangements described above, with vertical dividers, addresses the lateral separation of the exhaust from the turbine outlet. However, the traditional exhaust hood arrangement is not conducive to providing vertical division of the exhaust flow from the turbine outlet. Accordingly, it may be advantageous to provide an exhaust arrangement that vertically separates the flow from the upper and lower half of the turbine outlet exhaust annulus.

BRIEF DESCRIPTION OF THE INVENTION

The present invention relates to an exhaust arrangement for steam turbines between the outlet of turbine sections and condensers.

According to a first aspect of the present invention, an exhaust arrangement for a steam turbine is provided. The exhaust arrangement includes a first condenser and a first turbine section including a first turbine outlet in fluid communication with the first condenser. At least one external exhaust path is connected to an upper portion of the first turbine outlet, and at least one external exhaust path is connected to a lower portion of the first turbine outlet. At least one external exhaust path connected to the upper portion of the first turbine outlet is connected in fluid communication with the first condenser and at least one exhaust path connected to the lower portion of the first turbine outlet is connected in fluid communication to the first condenser.

According to a second aspect of the present invention, a steam turbine system is provided. The steam turbine includes a first turbine section with a first turbine outlet, and a first condenser in fluid communication with the first turbine outlet of the first turbine section. At least one external exhaust path is connected to an upper portion of the first turbine outlet, and at least one external exhaust path is connected to a lower portion of the first turbine outlet. At least one external exhaust path connected to the upper portion of the first turbine outlet connects in fluid communication to the first condenser. At least one exhaust path connected to the lower portion of the first turbine outlet connects in fluid communication to the first condenser.

According to a further aspect of the present invention, a steam turbine system is provided. The steam turbine system includes a double flow steam turbine including a first turbine section with a first turbine outlet and a second turbine section with a second turbine outlet. A high pressure turbine, an intermediate pressure turbine, or both turbines include a common rotor shaft rotationally connected with a rotor shaft of the double flow steam turbine. A first condenser is provided in fluid communication with the first turbine outlet of the first turbine section, and a second condenser is provided in fluid communication with the second turbine outlet of the second turbine section.

At least one external exhaust path is connected to an upper portion of the first turbine outlet and further connects in fluid communication with the first condenser. At least one external exhaust path is connected to a lower portion of the first turbine outlet and further connects in fluid communication with the first condenser. At least one external exhaust path is connected to an upper portion of the second turbine outlet and further connects in fluid communication with the second condenser. At least one external exhaust path connected to a lower portion of the second turbine outlet and further connects in fluid communication with the second condenser.

BRIEF DESCRIPTION OF THE DRAWING

These and other features, aspects, and advantages of the present invention will become better understood when the following detailed description is read with reference to the accompanying drawings in which like characters represent like parts throughout the drawings, wherein:

FIG. 3A illustrates a side view of a first embodiment for an exhaust arrangement from a first section of a steam turbine;

FIG. 3B illustrates an end view of a first embodiment for an exhaust arrangement from a first section of a steam turbine;

FIG. 3C illustrates an end view of a second embodiment for an exhaust arrangement from a first section of a steam turbine;

DETAILED DESCRIPTION OF THE INVENTION

The following embodiments of the present invention have many advantages, including providing separate external exhaust diffuser paths for the upper half and lower half of the turbine exhaust outlet annulus, thereby allowing for the advantageous diffusion of the separate upper and lower half of the turbine exhaust through external exhaust paths not limited by the traditional exhaust hood and further allowing the external exhaust paths to be exhausted to multiple condensers.

Figure 1:
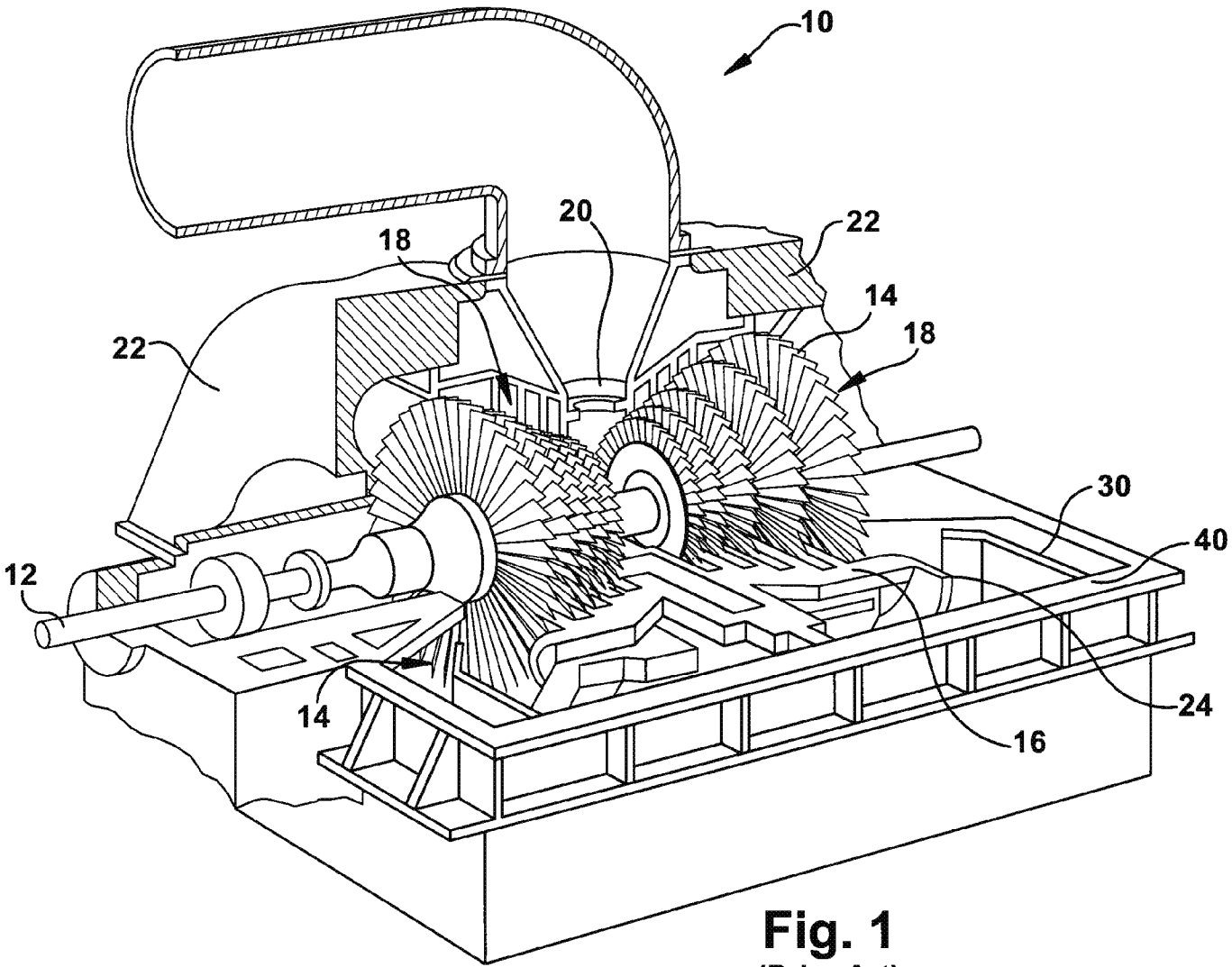
Fig. 1 (Prior Art)
FIG. 1 illustrates a perspective partial cutaway of a double flow steam turbine a portion of a steam turbine.
Figure 2:
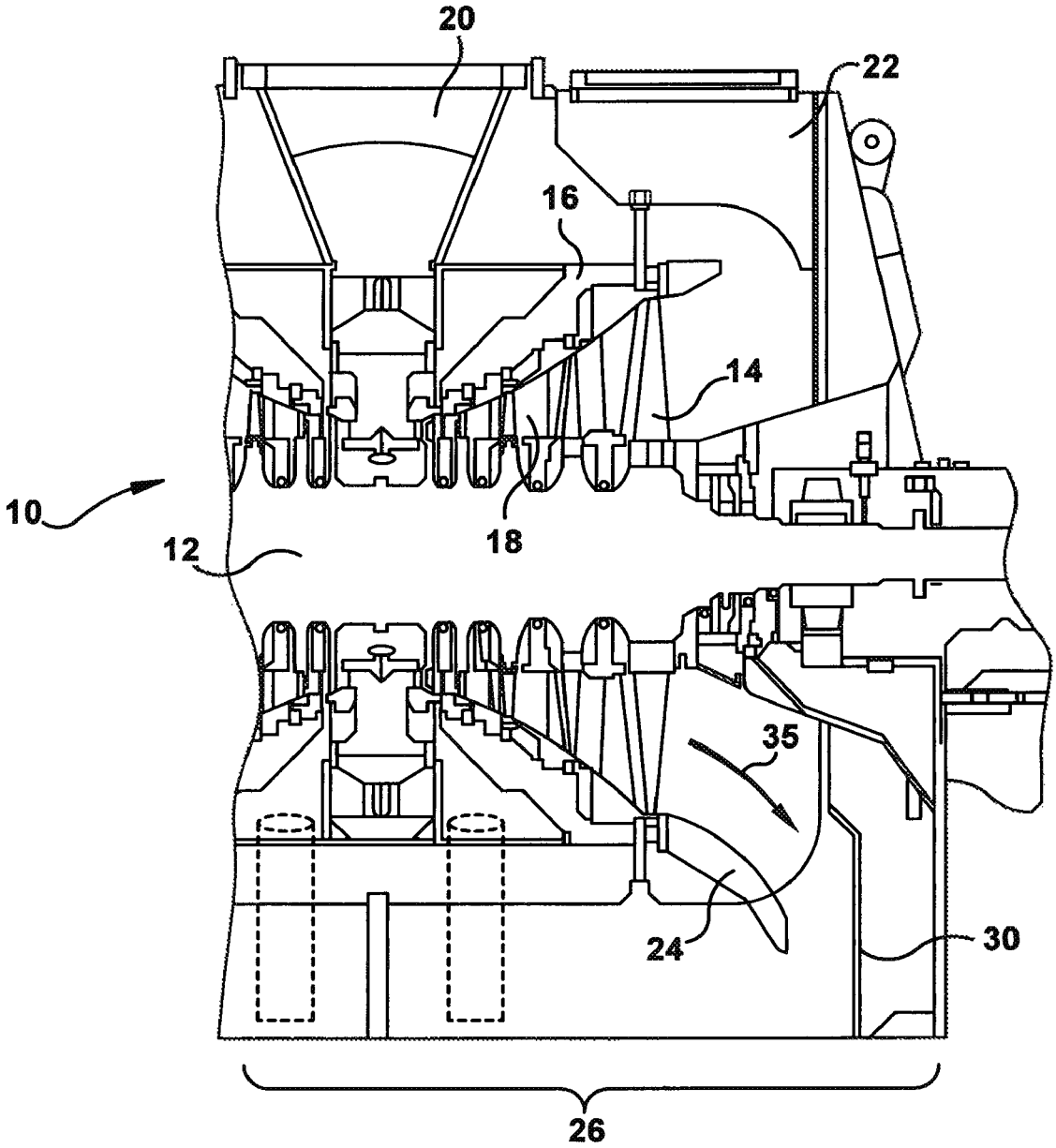
Fig. 2 (Prior Art)
FIG. 2 illustrates a portion of the double flow steam turbine including an exhaust flow path.

FIG. 3A illustrates a side view of a first embodiment for an exhaust arrangement from a first section of a steam turbine. The turbine exhaust arrangement 300 includes a first turbine section 310 of the steam turbine 301, which includes the rotor, blades, diaphragms casings and internal steam flow path as described in FIG. 1 and FIG. 2. The first turbine section 305 passes a steam inlet flow 310, delivering energy to the rotor, and exhausts into a first turbine outlet 315. The first turbine outlet 315 may include an upper portion 316 and a lower portion 317. The upper portion 316 of the first turbine outlet 315 may exhaust into one or more external exhaust paths for diffusion of the exhaust steam. The lower portion 317 of the first turbine outlet 315 may exhaust into one or more external exhaust paths for diffusion of the exhaust steam. FIG. 3A illustrates a single external exhaust path 320 from the upper portion 316 of the first turbine outlet 315 to a first condenser 330 and a single external exhaust path 325 from the lower portion 317 of the first turbine outlet 315 to the first condenser 330. FIG. 3B illustrates an end view of the first embodiment for an exhaust arrangement from a first section of the steam turbine. The exhaust paths 320 and 325 may be in fluid communication 335 external to the turbine section 305.

FIG. 3C illustrates an end view of a second embodiment for an exhaust arrangement 345 from the first section of the steam turbine. Herein the upper portion of the first turbine outlet 315 includes a first upper portion 318 and a second upper portion 319. A first upper external exhaust path 321 may draw exhaust from the first upper portion 318 and deliver the exhaust to the first condenser 330. A second upper external exhaust path 322 may draw exhaust from the second upper portion 319 and deliver the exhaust to the first condenser 330. In this embodiment, include a unitary external exhaust path 320 may draw exhaust from the lower portion of the first turbine outlet 315 into fluid communication with the first condenser 330. Although not shown, further embodiments may include multiple external exhaust paths between multiple lower portions of the first turbine outlet and the first condenser.

The external exhaust paths 320, 321, 322, 325 may include exhaust ducting external to the steam turbine, including various shapes and sizes of ducting. The external exhaust paths are provided in fluid communication between the turbine outlet section, as described above, and the first condenser 330. The external exhaust paths may further be tied together in fluid communication downstream from the steam turbine with tie 335. In a further variation of the external exhaust arrangement, the external exhaust paths may be merged external to the steam turbine into a common ducting that is in fluid communication with the first condenser.

Figure 4A:
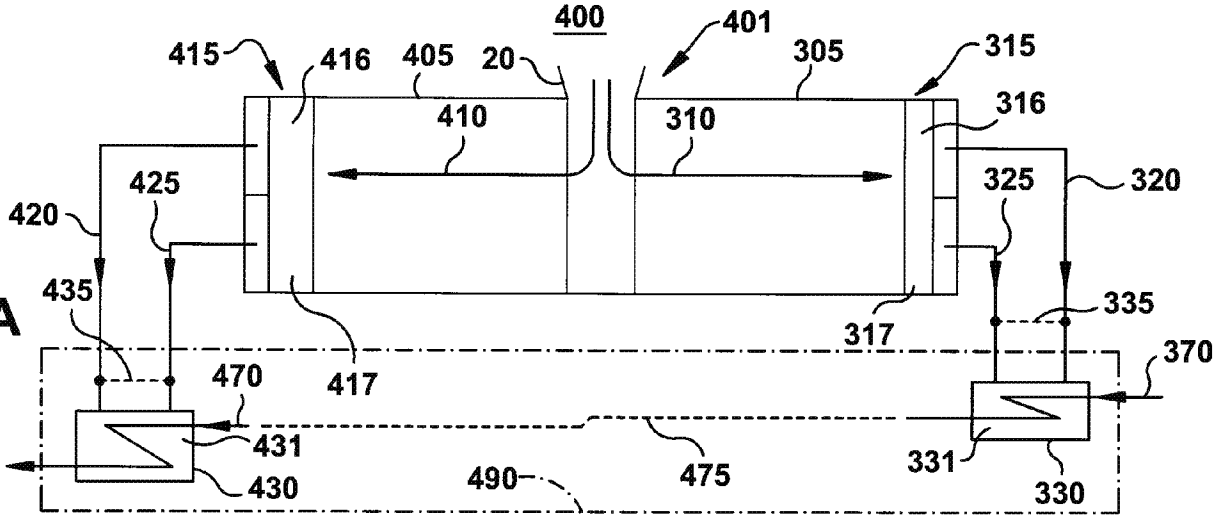
FIG. 4A illustrates a side view of a third embodiment for an exhaust arrangement from opposing ends of a double flow steam turbine.

FIG. 4A illustrates a side view of a third embodiment for an exhaust arrangement from opposing ends of a double flow steam turbine. The exhaust arrangement 400 for the double flow steam turbine 401 includes a first turbine section 305 and the associated exhaust path, as previously described and a second turbine section 405 and the associated exhaust path. The second turbine section 405 may include the rotor, blades, diaphragms, casings and steam flow path, as described in FIG. 1 and FIG. 2. The second turbine section 405 passes a steam inlet flow 410, delivering energy to the rotor (not shown), and exhausts into a second turbine outlet 415. The second turbine outlet 415 may include an upper portion 416 and a lower portion 417. The upper portion 416 of the second turbine outlet 415 may exhaust into one or more external exhaust paths for diffusion of the exhaust steam. The lower portion 417 of the second turbine outlet 415 may exhaust into one or more external exhaust paths 5 for diffusion of the exhaust steam. FIG. 4A illustrates a single external exhaust path 420 from the upper portion 416 of the second turbine outlet 415 to a second condenser 430 and a single external exhaust path 425 from the lower portion 417 of the second turbine outlet 415 to the second condenser 430. FIG. 4B illustrates an end view of the third embodiment for an exhaust arrangement from a second section of a steam turbine. FIG. 4B represents the end view for the first turbine section and the second turbine section, where the reference numbers for the second turbine section are provided in parentheses. Tie connection 435 may further connect, in fluid communication, the external exhaust paths 420, 425 downstream from the second turbine outlet 415. Further, downstream from the tie connection 435, the external exhaust paths 420, 425 may merge into a common external exhaust path to the second condenser 430.

Figure 4C:
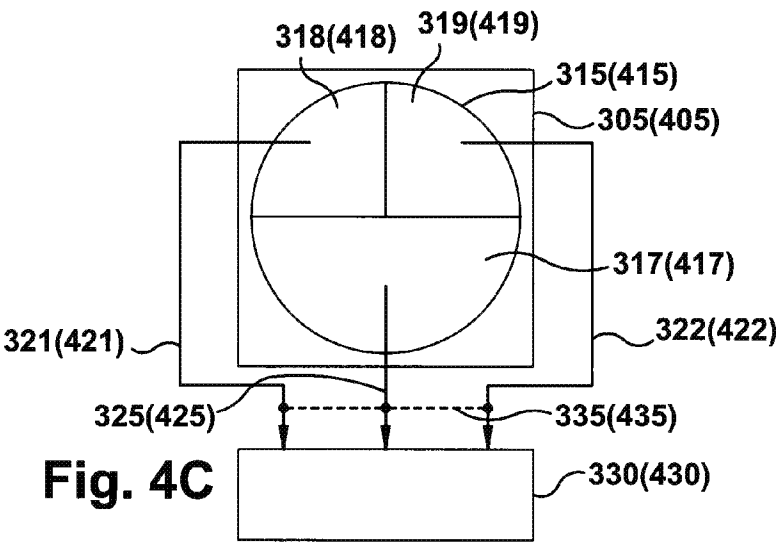
FIG. 4C illustrates an end view of a fourth embodiment for an exhaust arrangement of a double flow steam turbine.
Figure 4B:
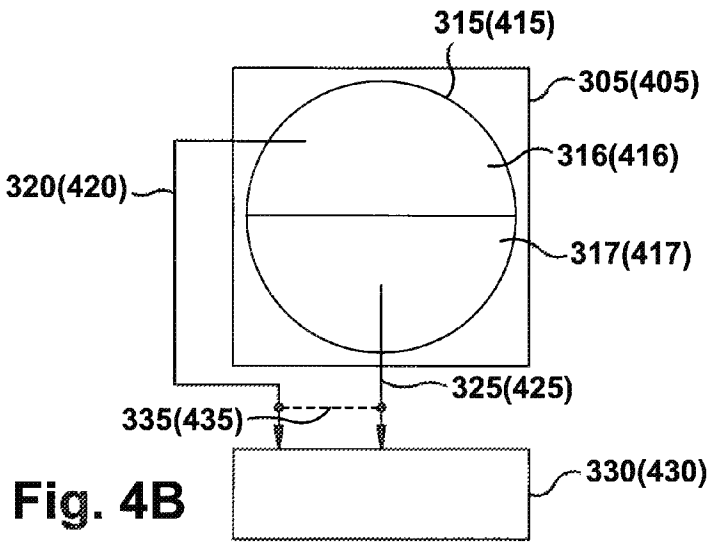
FIG. 4B illustrates an end view of a third embodiment for an exhaust arrangement of a double flow steam turbine.

FIG. 4C illustrates an end view of a third embodiment for an exhaust arrangement of a double flow steam turbine. FIG. 4C represents the end view for the first turbine section and the second turbine section, where the reference numbers for the second turbine section are provided in parentheses. Herein the upper portion of the second turbine outlet 415 includes a first upper portion 418 and a second upper portion 419. A first upper external exhaust path 421 may draw exhaust from the first upper portion 418 and deliver the exhaust to the second condenser 430. A second upper external exhaust path 422 may draw exhaust from the second upper portion 419 and deliver the exhaust to the second condenser 430. In this embodiment, include a unitary external exhaust path 425 may draw exhaust from the lower portion of the second turbine outlet 415 into fluid communication with the second condenser 430. Although not shown, further embodiments may include multiple external exhaust paths between multiple lower portions of the second turbine outlet and the second condenser. The end view of FIG. 4C may also represent the exhaust arrangement for the first turbine section.

In a further aspect of the present invention, a different annulus area may be provided for the last stage buckets on each end of the double flow low pressure turbine represented in FIG. 4C. In FIG. 4C for example, the first turbine section 305 may include a higher exit annulus area 380 than the exit annulus area 480 for second turbine section 405. With the larger annulus area, the first turbine section 305 may produce a larger output power and larger thrust than the second turbine section 405 with the lower exit annulus area. The external exhaust paths from the first turbine section may be provided to the first condenser and the external exhaust paths from the second turbine section may be provided to the second condenser, wherein the vacuum of the first condenser may be maintained at higher vacuum relative to the vacuum of the second condenser through known sizing of cooling surfaces of the respective condensers and selective cooling water flow and temperature. Further, the first condenser 330 and the second condenser 430 may be part of a single unified condenser 490. Still further, a cooling water flow 370 through the first condenser 330 and a cooling water flow 470 through the second condenser 430 may be in series, flowing from the first condenser through the second condenser.

Figure 5A:
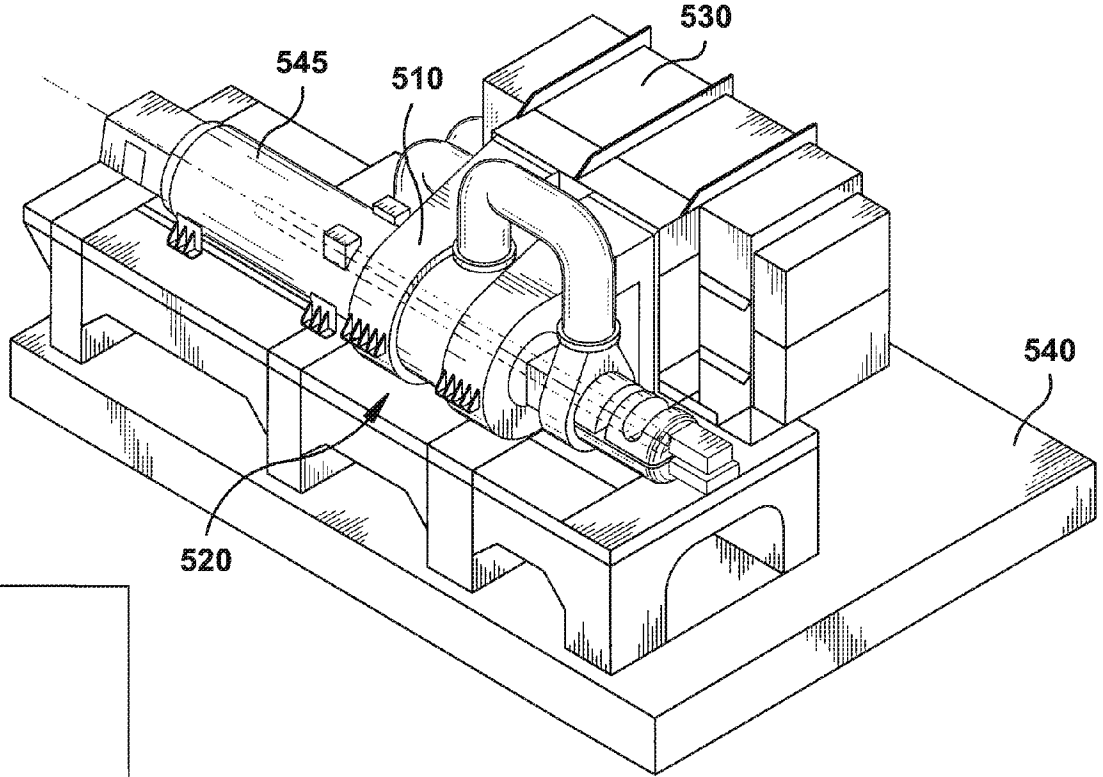
Fig. 5A (Prior Art)
FIG. 5A illustrates a conventional side exhaust from a double flow low-pressure steam turbine to a condenser.
Figure 5B:
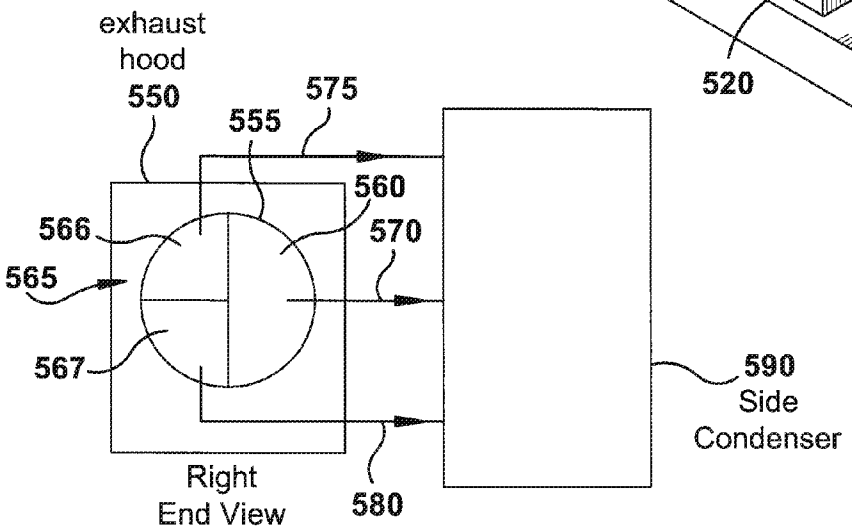
FIG. 5B illustrates an end view of a fifth embodiment of an exhaust flow from a double flow steam turbine to a side condenser.

Yet further, it may be appreciated that while previous depictions have related discharge to condensers located beneath the turbine, the present invention may also contemplate side exhaust discharge. Side exhaust discharge from a turbine to a condenser mounted adjacent to the turbine is known to avoid a significant vertical stackup of these large components. FIG. 5A illustrates a conventional side exhaust from a double flow low-pressure steam turbine 520 to a condenser 530 mounted on a common foundation 540 with electrical generator 545. Conventional side exhaust hood 510 directs steam exhaust from the steam turbine 520 to the condenser 530. FIG. 5B illustrates an end view of a fifth embodiment of an exhaust flow from a double flow steam turbine to a side condenser. An exhaust hood 550 encloses a turbine outlet 555. The turbine outlet 555 may include an adjacent portion 560 and an opposite portion 565 in physical relation to the side condenser (FIG. 5A, 530). The opposite portion 565 may further be divided into a first opposite portion 566 and a second opposite portion 567. An exhaust flow path 570 may be provided from the adjacent portion 560 of the turbine outlet 555 to a side condenser 590. An exhaust flow path 575 may be provided from the first opposite portion 566 of the turbine outlet 555 to the side condenser 590 and an exhaust path 580 may be provided from the second opposite portion 567 to the side condenser 590.

Figure 6:
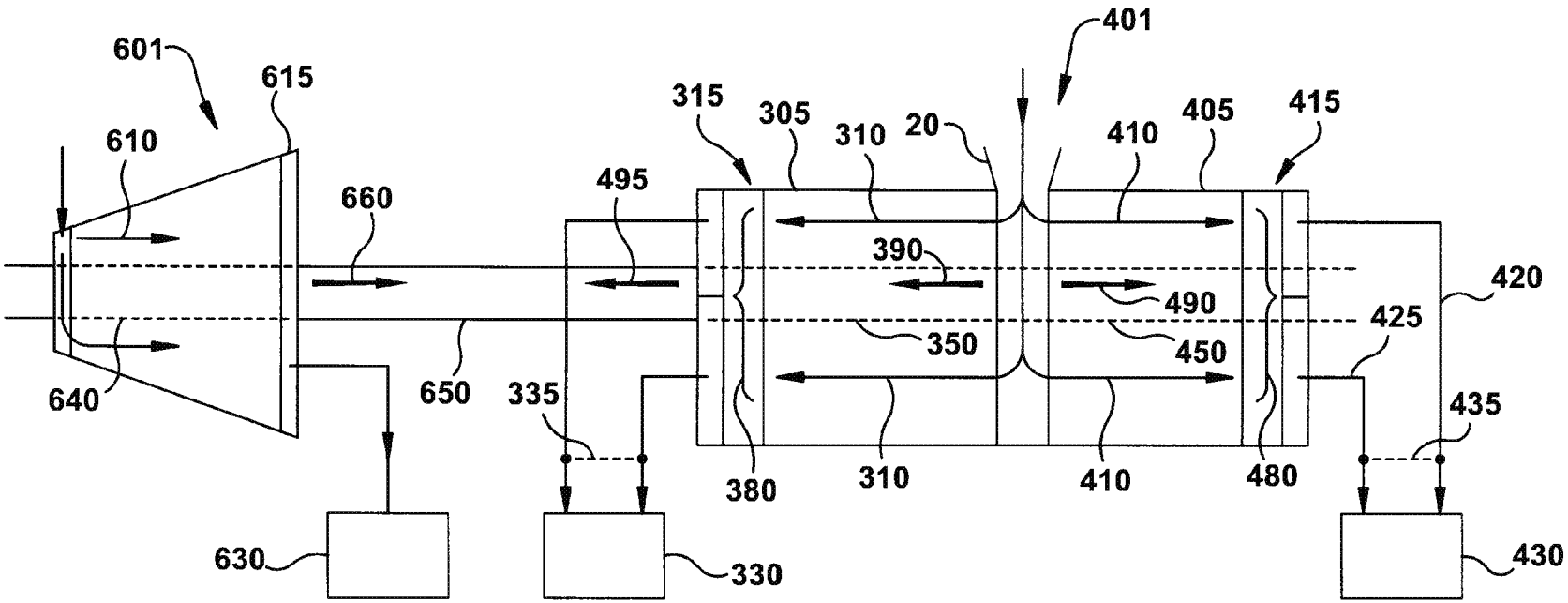
FIG. 6 illustrates a side view of a sixth embodiment providing thrust balancing of a single flow turbine by the net thrust of a double flow steam turbine.

FIG. 6 illustrates a side view of thrust balancing of a single flow turbine by the net thrust of a double flow steam turbine facilitated by exhaust control. The rotor 640 of single flow turbine 600 is mechanically connected with the rotors 350, 450 of double flow steam turbine 401 by a common shaft 650. The single flow steam turbine 601 may include a high pressure steam turbine and/or intermediate pressure steam turbine. The single flow steam turbine 601 comprises a turbine section 605 that may include the rotor, blades, diaphragms, casings and steam flow path, as described in FIG. 1 and FIG. 2. The turbine section 605 passes a steam inlet flow 610, delivering energy to the rotor 640, and exhausts into a turbine outlet 615. The steam action of the single flow steam turbine 600 on the rotor 640 causes a net thrust 660 on common shaft 650. Within double flow steam turbine 410, the steam flow 310 causes a thrust 390 and the steam flow 410 causes a thrust 490. Because the thrusts 390, 490 are in opposing directions, a net thrust 495 results, which is exerted through the respective rotors onto common shaft 650. Selective sizing of the exit annulus area 380 from the first turbine section 305 and the exit annulus area 480 from the second turbine section 405 may allow the net thrust 495 to be established as equal in magnitude and in opposite direction to net thrust 660 on single flow steam turbine 600. A balanced thrust on the combined single steam flow turbine/double steam flow turbine eliminates the need for a large and expensive thrust bearing for the common shaft 650.

While various embodiments are described herein, it will be appreciated from the specification that various combinations of elements, variations or improvements therein may be made, and are within the scope of the invention.

The invention claimed is:

1. An exhaust arrangement for a steam turbine, comprising:

a first condenser;

a first turbine section including a first turbine outlet in fluid communication with the first condenser;

at least one external exhaust path connected to an upper portion of the first turbine outlet;

at least one external exhaust path connected to a lower portion of the first turbine outlet; and wherein the at least one external exhaust path connected to the upper portion of the first turbine outlet is connected in fluid communication with the first condenser and wherein the at least one exhaust path connected to the lower portion of the first turbine outlet is connected in fluid communication to the first condenser, wherein the steam turbine comprises a double flow steam turbine with a second turbine outlet, the second turbine outlet being in fluid communication with a second condenser, and wherein the at least one external exhaust path connected to an upper portion of the second turbine outlet is in fluid communication with the second condenser and at least one external exhaust path connected to a lower portion of the second turbine outlet is in fluid communication with the second condenser.

2. The exhaust arrangement for a steam turbine according to claim 1, wherein the at least one external exhaust path connected to an upper portion of the first turbine outlet comprises a first upper external exhaust path in fluid communication with the first condenser and a second upper external exhaust path, in fluid communication with the first condenser and wherein the at least one external exhaust path connected to lower portion of the first turbine outlet comprises a unitary external exhaust path.

3. The exhaust arrangement for a steam turbine according to claim 1, wherein the at least one external exhaust path connected to an upper portion of the first turbine outlet comprises a first upper external exhaust path in fluid communication with the second condenser and a second upper external exhaust path in fluid communication with the second condenser and wherein the at least one external exhaust path connected to lower portion of the first turbine outlet comprises a unitary external exhaust path.

4. The exhaust arrangement for a steam turbine according to claim 3, wherein the first turbine section has a larger final stage steam path area than the second turbine section and the first condenser comprises a high vacuum condenser and the second condenser comprises a low vacuum condenser.

5. The exhaust arrangement for a steam turbine according to claim 4, wherein the first condenser includes a first part of a multiple part condenser and the second condenser includes a second part of multiple part condenser.

6. The exhaust arrangement for a steam turbine according to claim 5, further comprising a cooling water system for the first condenser and a cooling water system for the second condenser, wherein the cooling water system for the first condenser and a cooling water system for the second condenser are coupled in series.

7. The exhaust arrangement for a steam turbine according to claim 1, wherein the at least one external exhaust path connected to an upper portion of the first turbine outlet connects in fluid communication with the at least one external exhaust path connected to lower portion of the first turbine outlet forming a combined exhaust path to the first condenser and wherein the at least one external exhaust path connected to an upper portion of the second turbine outlet connects in fluid communication with the at least one external exhaust path connected to lower portion of the second turbine outlet forming a combined exhaust path to the second condenser.

8. The exhaust arrangement for a steam turbine according to claim 3, wherein the first upper external exhaust path and the second upper external exhaust path connected to the first turbine outlet connect in fluid communication with the at least one external exhaust path connected to lower portion of the first turbine outlet forming a combined exhaust path to the first condenser; and wherein the first upper external exhaust path and the second upper external exhaust path connected to the second turbine outlet connect in fluid communication with the at least one external exhaust path connected to lower portion of the second turbine outlet forming a combined exhaust path to the second condenser.

9. A steam turbine system, comprising:

a steam turbine including a first turbine section with a first turbine outlet;

a first condenser in fluid communication with the first turbine outlet of the first turbine section;

at least one external exhaust path connected to an upper portion of the first turbine outlet;

at least one external exhaust path connected to a lower portion of the first turbine outlet; and wherein the at least one external exhaust path connected to the upper portion of the first turbine outlet connects in fluid communication to the first condenser and wherein the at least one exhaust path connected to the lower portion of the first turbine outlet connects in fluid communication to the first condenser, wherein the steam turbine comprises a double flow steam turbine including a second turbine section with a second turbine outlet, the second turbine outlet being in fluid communication with a second condenser, and wherein the at least one external exhaust path connected to an upper portion of the second turbine outlet is in fluid communication with the second condenser;

and the at least one external exhaust path connected to a lower portion of the second turbine outlet is in fluid communication with the second condenser.

10. The steam turbine system according to claim 9, wherein the at least one external exhaust path connected to an upper portion of the first turbine outlet comprises a first upper external exhaust path and a second upper external exhaust path and wherein the at least one external exhaust path connected to lower portion of the first turbine outlet comprises a unitary external exhaust path.

11. The steam turbine system according to claim 9, wherein the first turbine section has a larger final stage steam path area than the second turbine section and the first condenser comprises a high vacuum condenser and the second condenser comprises a low vacuum condenser.

12. The steam turbine system according to claim 11, wherein the first condenser includes a first part of a multiple part condenser and the second condenser includes a second part of the multiple part condenser.

13. The steam turbine system according to claim 11, further comprising a cooling water system for the first condenser and a cooling water system for the second condenser, wherein the cooling water system for the first condenser and a cooling water system for the second condenser are coupled in series.

14. The steam turbine system according to claim 9, wherein the at least one external exhaust path connected to an upper portion of the first turbine outlet comprises a first upper external exhaust path and a second upper external exhaust path and wherein the at least one external exhaust path connected to lower portion of the first turbine outlet comprises a unitary external exhaust path.

15. The steam turbine system according to claim 9, wherein the at least one external exhaust path connected to an upper portion of the first turbine outlet comprises a first upper external exhaust path and a second upper external exhaust path and wherein the at least one external exhaust path connected to lower portion of the first turbine outlet comprises a first lower external exhaust path and a second lower external exhaust path.

16. A steam turbine system, comprising:

a double flow steam turbine including a first turbine section with a first turbine outlet and a second turbine section with a second turbine outlet;

at least one of a high pressure turbine and an intermediate pressure turbine including a common rotor shaft rotationally connected with a rotor shaft of the double flow steam turbine;

a first condenser in fluid communication with the first turbine outlet of the first turbine section and a second condenser in fluid communication with the second turbine outlet of the second turbine section;

at least one external exhaust path connected to an upper portion of the first turbine outlet wherein the at least one external exhaust path connected to the upper portion of the first turbine outlet connects in fluid communication with the first condenser;

at least one external exhaust path connected to a lower portion of the first turbine outlet; wherein the at least one exhaust path connected to the lower portion of the first turbine outlet connects in fluid communication with the first condenser;

at least one external exhaust path connected to an upper portion of the second turbine outlet wherein the at least one external exhaust path connected to the upper portion of the second turbine outlet connects in fluid communication with the second condenser; and at least one external exhaust path connected to a lower portion of the second turbine outlet; wherein the at least one exhaust path connected to the lower portion of the second turbine outlet connects in fluid communication with the second condenser.

17. The steam turbine system according to claim 16, wherein the at least one of a high pressure turbine and an intermediate pressure turbine produces a thrust presented to the common shaft, and wherein the first turbine section of the double flow steam turbine includes a larger final stage steam path area than the second turbine section of the double flow steam turbine, thereby producing a thrust on the common shaft substantially balancing a net thrust at a rated condition of operation.

18. The steam turbine system according to claim 17, wherein the at least one external exhaust path connected to an upper portion of the first turbine outlet comprises a first upper external exhaust path and wherein a second upper external exhaust path and wherein the at least one external exhaust path connected to lower portion of the first turbine outlet comprises a unitary external exhaust path; and wherein the at least one external exhaust path connected to an upper portion of the second turbine outlet comprises a second upper external exhaust path and wherein a second upper external exhaust path and wherein the at least one external exhaust path connected to lower portion of the second turbine outlet comprises a unitary external exhaust path.

* * * * *